United States Patent [19]

Zaidi

[11] Patent Number: 4,929,285

[45] Date of Patent: May 29, 1990

[54] ALUMINUM SHEET PRODUCT HAVING REDUCED EARING AND METHOD OF MAKING

[75] Inventor: Mohammad A. Zaidi, Monroeville, Pa.

[73] Assignee: Aluminum Company of America, Pittsburgh, Pa.

[21] Appl. No.: 347,183

[22] Filed: May 4, 1989

[51] Int. Cl.[5] ..... C22F 1/04

[52] U.S. Cl. ..... 148/11.5 A; 148/437; 148/438; 148/439; 148/440

[58] Field of Search ..... 148/11.5 A, 2, 437–440

[56] References Cited

U.S. PATENT DOCUMENTS

| | | | |
|---|---|---|---|
| 3,318,738 | 5/1967 | Winter | 148/2 |
| 3,802,931 | 4/1974 | Bylund | 148/11.5 |
| 4,000,009 | 12/1976 | Chatfield | 148/2 |
| 4,526,625 | 7/1985 | Merchant et al. | 148/2 |
| 4,609,408 | 9/1986 | Rodrigues et al. | 148/2 |

*Primary Examiner*—R. Dean

*Attorney, Agent, or Firm*—Andrew Alexander

[57] ABSTRACT

There is provided a method of fabricating sheet stock having reduced earing during container forming. The method comprises the steps of providing a body of an aluminum base alloy suitable for rolling into sheet stock for forming containers therefrom and hot rolling the body to provide a flat rolled product having a hot rolled structure. The flat rolled product is provided with 5 to 20% of the structure being recrystallized. Thereafter, it is annealed in the temperature range of 400° to 700° F. to provide a fully recrystallized product which is cold rolled to sheet stock having reduced earing during container forming.

16 Claims, No Drawings

ALUMINUM SHEET PRODUCT HAVING REDUCED EARING AND METHOD OF MAKING

BACKGROUND OF THE INVENTION

The present invention relates generally to making metal sheet in a manner that reduces the amount or degree of earing encountered when cans are made from the sheet.

The rims of drawn and ironed (D&I) cans often exhibit a number of high areas called ears and a number of intervening low areas called troughs. The ears are wavy symmetrical projections formed in the course of deep drawing or spinning as a result of directional properties or anisotropy in sheet. Ears occur in groups of 4 or 8 with the peaks of the projections located at 45 degrees and/or at 0 and 90 degrees to the rolling direction. Degree of earing is the difference between average height at the peaks and average height at the valleys, divided by average height of cup or can, multiplied by 100 and expressed in percent. The ears and troughs are a problem in that can making machinery requires an even, level rim, i.e., a small ear to trough height difference relative to average can height, in order to prevent jamming of the machinery and tearing of the cans. If a trimming operation is performed, the ear metal can generate a substantial amount of scrap metal, and a cost factor for each can trimmed. Hence, high earing, i.e., in excess of three percent, relative to mean cup height, is a problem that needs to be overcome and should be reduced as much as possible.

SUMMARY OF THE INVENTION

A principal object of this invention is to provide an improved aluminum based sheet product having reduced earing upon container forming.

Another object of this invention is to provide a method for producing sheet stock having reduced earing on forming.

Another object of this invention is to provide AA 3000 and 5000 series alloys in sheet stock having reduced earing.

And yet another object of this invention is to provide 3004 sheet stock having reduced earing when formed into containers such as beverage containers.

In accordance with these objects, there is provided a novel sheet stock and a resulting method of fabricating sheet stock having reduced earing during container forming. The method comprises the steps of providing a body of an aluminum base alloy suitable for rolling into sheet stock for forming containers therefrom and hot rolling the body to provide a flat rolled product having a partially recrystallized but predominantly hot rolled structure. The flat rolled product is provided with 5 to 20% of a structure being recrystallized. Thereafter, it is annealed in the temperature range of 400° to 700° F. to provide a fully recrystallized product, the anneal rate being controlled so as to promote the growth of recrystallization originating from cube grains. The flat rolled product is then cold rolled to sheet stock having reduced earing during container forming.

DETAILED DESCRIPTION OF THE PREFERRED EMBODIMENTS

Aluminum based alloys which respond to thermal mechanical processing in accordance with the present invention include the Aluminum Association 3000 series and 5000 series, for example. Such alloys include, for example, 3002, 3102, 3003, 3303, 3004, 3104, 3005, 3105, 3006, 3007, 3107, 3010, 3011, 5005, 5205, 5006, 5010, 5040, 5050, 5051, 5151, 5351, 5052, 5252, 5352, 5652, 5154, 5254, 5454, 5554, 5654, 5056, 5356, 5456, 5556, 5357, 5457, 5557, 5657, 5082, 8182, 5083, 5183, and 5086.

Aluminum Association 3004 alloy, for example, contains 1.0 to 1.5 wt. % Mn, 0.8 to 1.3 wt % Mg, 0.3 wt. % max. Si, 0.7 wt. % max. Fe, 0.25 wt % max. Cu, 0.25 wt. % max. Zn, the balance aluminum, incidental elements and impurities. Alloy 3004 responds readily to thermal mechanical processing in accordance with the present invention.

While reference has been made to AA 3000 and 5000 series aluminum alloys, it will be understood that the invention can be applied to other heat treatable alloys such as the AA 2000 and 6000 series aluminum alloys as well as AA 8000 alloys, which include lithium, e.g., 8090 and 8091. Thus, typical AA 2000 series alloys which may be included are AA 2024, 2124, 2324, 2219, 2519, 2014, 2618, 2034, 2090 and 2091, and typical of AA 6000 series alloys are 6061 and 6013. Products formed from these alloys have oxygen content of less than 0.1 wt. %. Further, the products, e.g., flat rolled products, are substantially free of the as-cast structure.

As well as providing the alloy product with controlled amounts of alloying elements as described herein, it is preferred the alloy be prepared according to specific method steps in order to provide the most desirable characteristics of reduced earing during container fabrication. By following the method steps, the sheet product can have earing of 2% or less during container and can forming. Thus, the alloy as described herein can be provided as an ingot or billet (for fabrication into a suitable wrought product) by casting techniques currently employed in the art for cast products, with continuous casting being preferred. The ingot or billet may be preliminarily worked or shaped to provide suitable stock for subsequent working operations. Prior to the principal working operation, the alloy stock is preferably subjected to homogenization, and preferably at metal temperatures in the range of 750° to 1100° F., preferably 850° to 1050° F., for a period of time of at least one hour to dissolve soluble elements and to homogenize the internal structure of the metal. A preferred time period is about 5 to 20 hours or more in the homogenization temperature range. Normally, the heat up and homogenization treatment does not have to extend for more than 40 hours; however, longer times are not normally detrimental. A time of 20 to 40 hours at the homogenization temperature has been found quite suitable.

Typically, the ingot is hot rolled to a thickness in the range of 0.080 to 0.25 inch. Thereafter, the flat rolled product may be formed into a coil. After the hot rolling has been performed, the flat rolled product has a hot rolled structure and texture. That is, the structure will have a highly worked structure containing recovered subgrain and retaining as-worked crystallographic texture. During hot rolling, the ending temperature of rolling of the flat rolled product should not be less than 400° F. and typically 500° F. or greater, e.g., up to 700° F. For AA3004, this temperature can be 520° to 570° F.

After hot rolling, the flat rolled product can be permitted to self anneal by virtue of the heat maintained or stored in the coil noted above, the annealing resulting from the controlled temperature at the end of the hot rolling. It will be understood that this is one method which permits the self anneal, and other methods may be used which provide the same results. Self-annealing or treatment steps permit the flat rolled product structure to develop about a 5 to 20% recrystallized structure randomly distributed throughout the hot rolled texture. A 5 to 10% recrystallizezd structure is satisfactory for alloys such as AA 3004. This recrystallized structure originates from cube grains which are predominantly in cube orientation, i.e., the (001) planes are parallel to the sheet rolling plane and the [100] directions are parallel to the rolling direction. For purposes of providing sheet stock with reduced earing, it is the cube grains or recrystallized structure originating therefrom which is so necessary to the present invention. Thus, the purpose of the self-anneal is the promotion or controlled nucleation of the recrystallized structure. The 5 to 20% recrystallized structure is important in another sense in that it is believed to act as seed sites for the following controlled anneal or ramped anneal to develop a more completely recrystallized structure. Thus, the slow rate of heating during annealing is required to enhance the recovery of the worked structure and suppress nucleation of new grains.

The controlled or ramped anneal is important in that it permits the continued growth of recrystallized structure or cube grain structure as opposed to other or non-cube structures such as gross texture and retained rolling texture. If the anneal is not controlled, then the undesired structure, e.g., non-cube structure predominates and the balance desired between rolling texture and recrystallized texture is not obtained.

The ramped anneal referred to herein is an annealing treatment wherein in the temperature range specified, the annealing temperature is increased with time of anneal. For purposes of the present invention, a starting temperature can be as low as 400° F. and the ending temperature can be as high as 700° F. or even higher, depending on the alloy composition. Preferably, the ramp annealing temperature range is 500° to 650° F. with a typical range being 500° to 600° F. For purposes of AA 3004, for example, the temperature range can be 540° to 590° F. In the ramped anneal temperature range, the temperature can be increased at 0.5° to 50° F./hr. and preferably at 1 to 20° F./hr. but the temperature increase is controlled in these ranges so as to prevent or reduce new grain nucleation which may be non-cube type. Typically, rates can be 1° to 5° F./hr. The time from the beginning to the end of the ramped anneal can range from 5 to 40 hours or even longer. However, longer times may be uneconomical. Typical times are about 8 to 24 hours. The ramp anneal can include a series of increases in temperature with a holding time at temperature plateau or series of plateaus. Further, it can include even increases in temperature followed by decreases in temperature until the final ending temperature is reached. Also, there may be even holding plateaus at any one or more temperature level.

Thereafter, the flat rolled product is cold rolled to final gauge in the range of 0.010 to 0.015 inch. The percentage of cold work should be kept as high as possible to maximize the strength of sheet stock. Thus, the flat rolled coil may be cold worked to provide 80 to 92% reduction, preferably about 90% reduction to gauge thickness.

The new process has the advantage of producing sheet stock having low earing, e.g., 2% or less. If earing is reduced by about 0.5%, this can increase productivity by as much as 15 million cans per year for a beverage can maker.

Having thus described the invention, what is claimed is:

1. A method of fabricating sheet stock having reduced earing during container forming, the method comprising the steps of:

(a) providing a body of an aluminum base alloy suitable for rolling into sheet stock for forming containers therefrom;

(b) hot rolling said body to provide a flat rolled product having a partially recrystallized but predominantly hot rolled structure with 5 to 20% of said structure being recrystallized;

(c) annealing said flat rolled product at a controlled heat-up rate of 0.5° to 50° F./hr. in a temperature range of 400° to 700° F. to provide said product in a fully recrystallized condition; and (d) cold rolling said annealed product to sheet stock which has reduced earing during container forming.

2. The method in accordance with claim 1 wherein the body is heated in a temperature range of 750° to 1100° F. prior to said rolling step.

3. The method in accordance with claim 1 wherein in the hot rolling step at the end of said step, the temperature of said flat rolled product is greater than 400° F.

4. The method in accordance with claim 1 wherein in the hot rolling step at the end of said step, the temperature of said flat rolled product is greater than 500° F.

5. The method in accordance with claim 1 wherein in the hot rolling step, the temperature of the body is maintained between 500° and 750° F.

6. The method in accordance with claim 1 wherein the 5 to 20% recrystallized material is located in the flat rolled product approximate the T/2 location.

7. The method in accordance with claim 1 wherein the body is comprised of a 3000 series alloy.

8. The method in accordance with claim 1 wherein the body is comprised of a 3004 series alloy.

9. The method in accordance with claim 1 wherein the reduction of the flat rolled product by cold rolling is in the range of 80 to 92%.

10. A method of fabricating sheet stock having reducing earing during container forming, the method comprising the steps of:

(a) providing a body of 3000 series aluminum base alloy suitable for rolling into sheet stock for forming containers therefrom;

(b) hot rolling said body in the range of 500° to 750° F. to form a flat rolled product having hot rolled texture exhibiting a 5 to 20% fraction thereof which is recrystallized and located approximate the T/2 location;

(c) ramp annealing said flat rolled product in a range of 500° to 600° F. at a rate of 0.5° to 50° F./hr to maintain said 5 to 20% fraction in the recrystallized condition; and (d) cold rolling said annealed product to sheet stock, said cold rolling reducing the thickness of said flat rolled product by at least 80%, said sheet stock having reduced earing during container forming.

11. The method in accordance with claim 10 wherein earing is reduced below about 2%.

12. The method in accordance with claim 10 wherein the alloy is AA 3004.

13. Sheet stock having reduced earing during container forming, the sheet stock comprised of AA 3004 alloy and having a 5 to 20% fraction approximate the T/2 location comprised of recrystallized structure after a hot rolling operation, the remainder of said sheet stock comprised of an unrecrystallized structure.

14. The sheet stock in accordance with claim 13 wherein the recrystallized structure resulted from hot rolling a body of said alloy while maintaining said alloy in the range of 400° to 700° F.

15. The sheet stock in accordance with claim 14 wherein the recrystallized structure is maintained by annealing at 500° to 650° F.

16. The sheet stock in accordance with claim 13 wherein said sheet stock has less than 2% earing during container forming.

* * * * *